United States Patent [19]

Weddle

[11] Patent Number: 4,598,565

[45] Date of Patent: Jul. 8, 1986

[54] SEAL STRIP BENDING DEVICE FOR STEAM TURBINES

[75] Inventor: Stewart C. Weddle, Independence, Mo.

[73] Assignee: Westinghouse Electric Corp., Pittsburgh, Pa.

[21] Appl. No.: 701,261

[22] Filed: Feb. 13, 1985

[51] Int. Cl.[4] ..... B21D 5/14

[52] U.S. Cl. ..... 72/170; 72/166

[58] Field of Search ..... 72/172, 173, 170, 166

[56] References Cited

U.S. PATENT DOCUMENTS

| | | | |
|---|---|---|---|
| 395,488 | 1/1889 | Dale | 72/170 |
| 469,763 | 3/1892 | Williams | 72/170 |
| 2,093,933 | 9/1937 | Sinclair | 72/171 |
| 3,842,473 | 10/1974 | Couper | 72/166 |

FOREIGN PATENT DOCUMENTS

| | | | |
|---|---|---|---|
| 1078153 | 5/1980 | Canada | 72/170 |

*Primary Examiner*—W. D. Bray

*Attorney, Agent, or Firm*—R. S. Lombard

[57] ABSTRACT

A seal strip bending device for changing the diameter of seal strips used for pressure sealing strips of a steam turbine. The seal strips have a substantially L-shaped cross-section. The device includes a frame which houses a first roller having a first groove therein and a second roller spaced a predetermined clearance from the first roller such that the L-shaped seal strip is pulled through the first and second means to contact an adjustable bending roller to increase or decrease the diameter of the seal strip as desired.

8 Claims, 6 Drawing Figures

SEAL STRIP BENDING DEVICE FOR STEAM TURBINES

BACKGROUND OF THE INVENTION

This invention relates generally to steam turbines and, in particular, to a bending device to enable on-the-job bending of the seal strips for a steam turbine. The seal strips in a steam turbine function to maintain pressure within the various stages as is known in the art. The seal strips generally are attached to the turbine casing and stationary blade structure. Typically, each stage in a steam turbine includes a set of stationary blades and a set of moving blades. The seal strips, after time, tend to become eroded or begin to wear. This results in a loss of pressure in the corresponding stage of the steam turbine and ultimately an overall loss of efficiency for the turbine. There is a variety of steam turbines in use today with numerous diameter casings and stationary blade structures which prevent the stocking by servicing personnel of the necessary sizes of seal strips. The seal strip is an alloy steel as is known in the art and the diameters of seal strips vary from as small as 20" to as large as at least 100". Typically, the seal strip will have a length equal to one-half the circumference of the turbine casing or stationary blade structure of the turbine.

Problems often arise at the job site because replacement seal strips that are available are of the wrong diameter and the customer's stock of seal strips is limited and often not the specific sizes needed during the outage of the turbine. This often causes delays until the correct diameter replacement seal strips are obtained.

SUMMARY OF THE INVENTION

The present invention obviates the problem of the prior art in providing a seal strip bending device that enables personnel servicing a steam turbine to bend seal strips available at the job site to whatever diameter necessary for the replacement installation of the seal strips.

The seal strip bending device of the present invention is for bending seal strips that are used for pressure sealing a stage of the steam turbine. The seal strips typically consist of an elongated metallic strip member having a substantially L-shaped cross-section. The L-shaped cross-section includes a relatively long central portion and a relatively short lip portion. The device is for bending the seal strip along its length to a predetermined diameter.

The device comprises a frame including a bottom horizontal support member. The bottom support member has affixed thereto at a predetermined distance from one another a pair of substantially parallel vertical wall members. The wall members are affixed to the bottom support member at the bottom edges of the wall members. The wall members at the top edges thereof have affixed thereto a top horizontal support member. The top horizontal support member is of predetermined dimensions.

The device further comprises a first cylindrical roller means. The first roller means is supported horizontally by and between the wall members. The first roller has a first groove therein around the circumference thereof of predetermined dimensions. Means are provided for supporting the first cylindrical roller including a first cylindrical shaft being supported by the wall members. A second cylindrical roller means is supported horizontally by and between the wall members with the axis of the second roller lying in substantially the same plane as the axis of the first roller at a predetermined distance beneath the first roller. Means for supporting the second cylindrical roller includes a second cylindrical shaft being supported by the wall members. The second shaft is in supportive relationship with the second cylindrical roller.

The device also includes adjustable bending means including a pair of elongated arms of substantially equal length. Each of the elongated arms has first aperture means therethrough proximate one end thereof. Each of the arms has the first shaft passing through the first aperture means of the arms in supportive relationship therewith. One of the arms is positioned proximate one end of the first cylindrical roller and the other of the arms is positioned proximate the other end of the first cylindrical roller. Each of the arms is movable on the first shaft. A cylindrical bending roller is positioned between and supported by the arms at a predetermined distance from the first cylindrical roller. The bending roller has second aperture means passing therethrough at predetermined positions. The bending roller has threading of predetermined size along the periphery of the second aperture means. Adjustment means is provided including screw members passing through the second aperture means engaging the threading.

The device further includes means for turning the first and second shafts. The first roller and second roller are spaced a predetermined clearance from one another, where the clearance is substantially equal to the thickness of the L-shaped cross-section at the relatively short lip portion. Whereby when inserting one end of the seal strip in the first groove of the first roller, such that the lip portion of the L-shaped cross-section of the seal strip is held in the clearance between the first and second rollers, upon the turning of the handle, the seal strip is fed to contact the bending roller means, the adjustment means is adjusted to vary the diameter of the seal strip as desired.

Preferably, the means for turning includes a handle mounted proximate one end of the first shaft. First gear means mounted on the first shaft in predetermined position. Second gear means mounted on the second shaft in predetermined position in working engagement with the first gear means.

In one embodiment, the first cylindrical roller comprises a third hollow cylindrical roller. The third roller has a first roller portion of predetermined dimensions. The third roller has a first coaxial opening at one end thereof of predetermined diameter and predetermined depth. A fourth cylindrical roller has a second roller portion with predetermined dimensions. The fourth roller has at one end thereof an engagement member section of predetermined dimensions sized to engage the first coaxial opening of the third roller such that a predetermined clearance remains between the third and fourth rollers defining the first groove of the first cylindrical roller.

Preferably, the depth of the first groove is a predetermined amount greater than the length of the central portion of the L-shaped cross-section of the seal strip and the width of the first groove is a predetermined amount greater than the maximum width of the central portion of the L-shaped cross-section of the seal strip.

Other embodiments are also disclosed.

It has been found that by utilizing the present invention, the steam turbine customer can keep a smaller inventory of seal strips resulting in less cost to the customer. Repair can be implemented during scheduled outages because of the parts availability, i.e., utilizing the present invention the diameters of the seal strips in stock may be altered to the diameters desired. This results in increased efficiency of the customer's unit.

BRIEF DESCRIPTION OF THE DRAWINGS

For a better understanding of the invention, reference may be had to the accompanying drawings exemplary of the invention, in which.

DESCRIPTION OF THE REFERRED EMBODIMENTS

Figure 1:
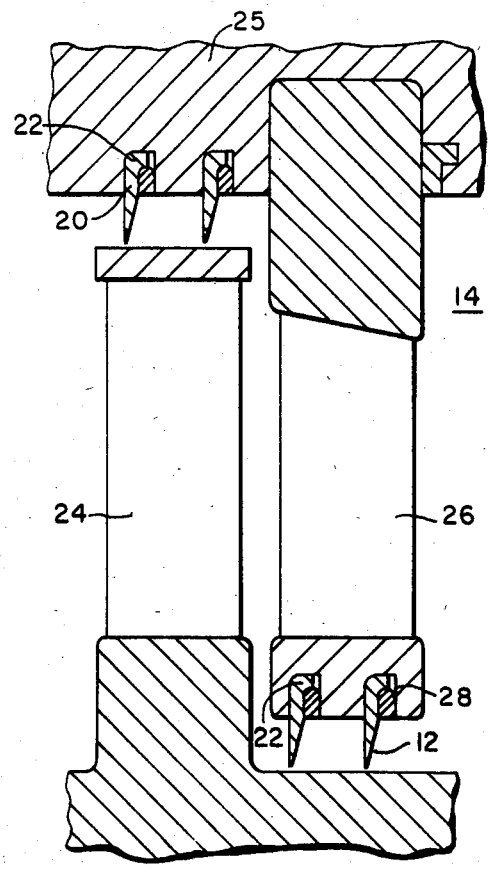
FIG. 1 is a cross-sectional elevational view of a portion of a stage of a steam turbine showing the typical location of the seal strips.
Figure 2:
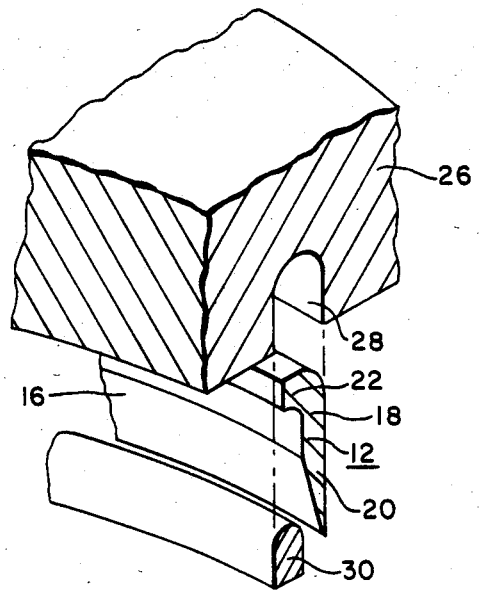
FIG. 2 is an isometrical exploded view of the seal strip and its alignment relationship with the slot in the stationary blade structure of the turbine together with the caulking piece strip.

Referring to FIGS. 1 and 2 there is shown a steam turbine stage 14. A seal strip 12 is provided for pressure sealing the steam turbine stage 14. The seal strip 12 consists of an elongated metallic strip member 16 typically made of an alloy steel as known in the art. The strip member 16 has a substantially L-shaped cross-section 18. The L-shaped cross-section 18 includes a relatively long central portion 20 and a relatively short lip portion 22 as shown in FIG. 2. The device 10 is for bending the seal strip 12 along its length to a predetermined diameter. The steam turbine stage 14 typically includes rotating blade structure 24, casing 25 and stationary blade structure 26 as shown in FIG. 1. The seal strip 12 is positioned in circumferential slots 28 in the casing 25 and stationary blade structure 26. Caulking strip piece 30 maintains the seal strip in position within the slot 28 as is known in the art. The seal strips 12 generally have a diameter as small as 20" and as large as 100" or greater. The seal strip 12 typically comes in lengths equal to one-half or less the circumference of the slots 28. The long central portion 20 of the seal strip may be $\frac{3}{4}$" in length with a thickness of 3/32" for example. The short lip portion 22 may be $\frac{1}{3}$" in length and 3/32" in thickness, for example.

Referring to FIGS. 3–6, a seal strip bending device 10 is provided which comprises a frame means 32. The frame means 32 may be made of steel, for example, and includes a bottom horizontal support member 34. The bottom horizontal support member 34 has affixed thereto at a predetermined distance, such as 3" from one another, a pair of substantially parallel vertical wall members 36*a*, 36*b*. The wall members 36*a*, 36*b* are affixed to the bottom support member 34 at the bottom edges 38*a*, 38*b* of the wall members 36*a*, 36*b*. The wall members 36*a*, 36*b* at the top edges 40*a*, 40*b* thereof have affixed thereto a top horizontal support member 42. The top horizontal support member is of predetermined dimensions such as 4" long × 1" wide × $\frac{1}{4}$" thick.

The device 10 further includes a first cylindrical roller means 44. The first roller means 44 is supported horizontally by and between wall members 36*a*, 36*b*. The first roller 44 has a first groove 46 therein around the circumference thereof of predetermined dimensions. Preferably, the depth of the first groove 46 is a predetermined amount greater than the central portion 20 of the L-shaped cross-section 18, such as a 0.001" clearance between the bottom of said groove and said central portion. Also, the width of the first groove 46 should be a predetermined amount greater than the maximum width central portion 20 of the L-shaped cross-section 18, such as a 0.002" clearance. Thus, for different seal strips having different cross sections, a different first roller means should be utilized so that the first groove 46 corresponds to the cross-sectional size of the seal strip 12. The first groove 46 maintains the seal strip 12 in proper alignment and prevents twists of the seal strip.

The device also includes means 48 for supporting the first cylindrical roller means 44 including a first cylindrical shaft means 50 which is supported by the wall members 36*a*, 36*b*. A second cylindrical roller means 52 is supported horizontally by and between the wall members 36*a*, 36*b* with the axis 54 of the second roller means 52 lying in substantially the same plane as the axis 56 of the first roller 44 with a predetermined clearance between the first and second rollers. Preferably, the clearance between the first and second rollers is a predetermined amount greater than the maximum thickness of the lip portion 22, such a 0.030". The first roller 44 and the second roller 52 are spaced such that contact is made with the seal ring 12 to pull the seal strip through the rollers 44, 52. Means 58 for supporting the second cylindrical roller 52 is provided including a second cylindrical shaft means 60.

The device 10 further includes adjustable bending means 62 including a pair of elongated arms 64*a*, 64*b* of substantially equal length, such as $4\frac{1}{8}$". Each of the elongated arms 64*a*, 64*b* has first aperture means 68 therethrough proximate one end 70 thereof. Each of the arms 64*a*, 64*b* having the first shaft means 50 passing through the first aperture 68 of the arms 64*a*, 64*b* in supportive relationship therewith. One of the arms 64*a* is positioned proximate one end 72*a* of the first cylindrical roller 44. The other of the arms 64*b* is positioned proximate the other end 72*b* of the first cylindrical roller 44. Cylindrical bending roller means 74 is positioned between and supported by the arms 64*a*, 64*b* at a predetermined distance, such as 2" from the first cylindrical roller 44. The bending roller means 74 has second aperture means 76 therethrough at predetermined positions such as located $\frac{1}{2}$" from the inner surface 78 of the arm members 64*a*, 64*b*. The bending roller means 74 has first threading 78 along the periphery 80 of the second aperture 76. Adjustment means 82 is provided including screw members 84*a*, 84*b* passing through the second aperture 76 engaging the first threading 78.

Figure 3:
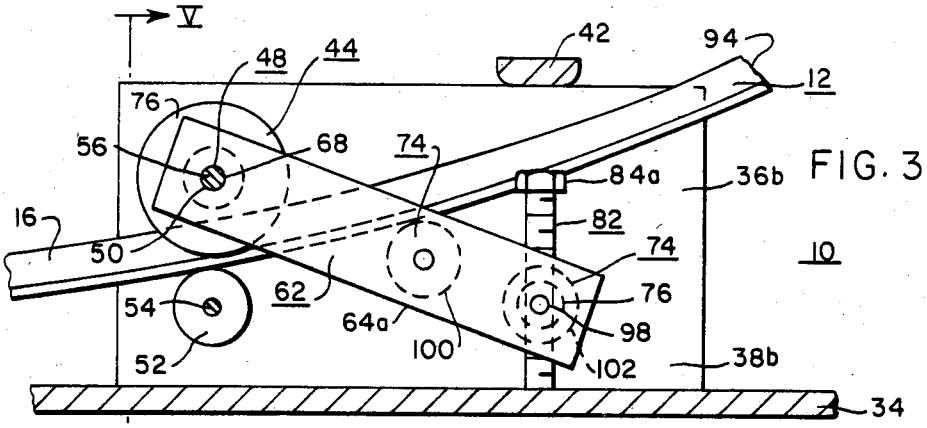
FIG. 3 is a cross-sectional side-elevational view of the seal strip bending device showing the device in alignment for decreasing the diameter of a seal strip.
Figure 4:
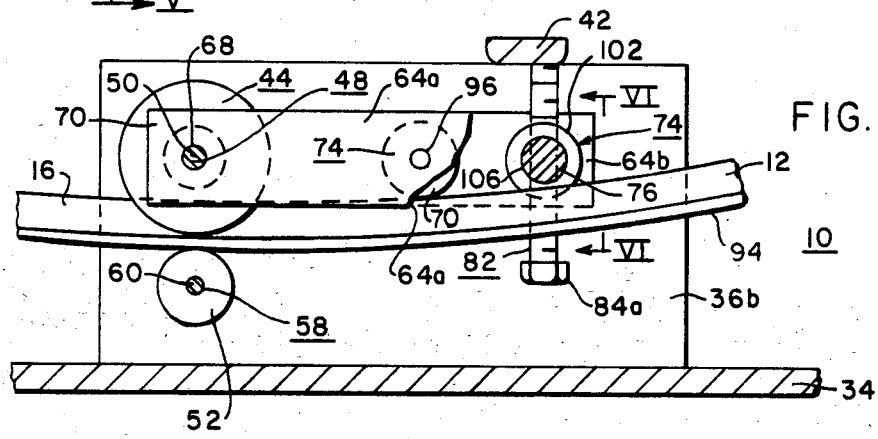
FIG. 4 is a cross-sectional side-elevational view of the seal strip bending device showing the device in position for increasing the diameter of a seal strip.
Figure 5:
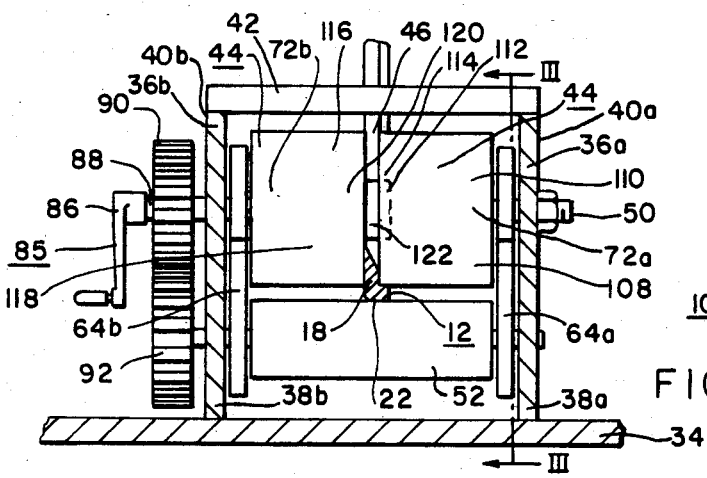
FIG. 5 is a cross-sectional front-elevational view of the seal strip bending device showing the position of a cross-section of the seal strip in position within the device.

The device 10 also includes means 85 for turning the first shaft 50 and the second shaft 60. Preferably, the means 85 for turning the first shaft 50 and the second shaft 60 includes handle means 86 proximate one end 88 of the first shaft 50. First gear means 90 is mounted on the first shaft 50 in predetermined position as shown in FIG. 5. Second gear means 92 is mounted on the second shaft 60 in predetermined position such that it is in working engagement with the first gear 90 as shown in FIG. 5, whereby when inserting one end 94 in the first groove 46 of the first roller 44 such that the lip portion 22 of the L-shaped cross-section 18 of the seal strip 12 is held in the clearance between the first and second rollers, upon the turning of the handle 86, the seal strip 12 is fed to contact the bending roller means 74, the adjustment means 82 is adjusted to vary the diameter of the seal strip as desired. With reference to FIG. 3, it has been found using the arrangement as shown that with each pass of a seal strip a 1" decrease in diameter may be obtained, for example. FIG. 4 shows an alternative arrangement of the device wherein the screw members 84*a*, 84*b* are reversed and threaded in the opposite direction through the second aperture 76 and contact the top support means 42. With this arrangement, the bending roller means is utilized to increase the diameter of the seal strip as desired.

Figure 6:
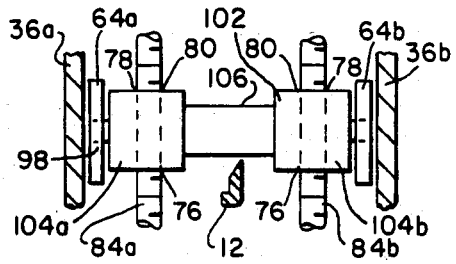
FIG. 6 is a fragmentary view taken along the line VI—VI of FIG. 4, showing the sixth roller means.

Preferably, the arms 64*a*, 64*b* of the bending means 62 have third aperture means 96 therethrough positioned a predetermined distance such as 2" from the center of the first aperture 68. Each of the arms 64*a*, 64*b* having fourth aperture means 98 therethrough positioned a predetermined distance such as $\frac{7}{8}$" from the center of the third aperture means 96. Preferably, the cylindrical bending roller means 74 includes a fifth bending roller means 100 passing through the third aperture 96 of the arms 64*a*, 64*b* proximate the ends 70 thereof. The fifth bending roller 100 is rotatable within the third aperture 96. A sixth roller means 102 passes through the fourth aperture 98 of the arms 64*a*, 64*b* proximate the ends 104*a*, 104*b* of the sixth roller. The sixth roller is preferably rotatable within the fourth aperture 98. The sixth roller 102 has the second aperture means 76 passing therethrough as shown in FIG. 4. Preferably, the sixth roller has a second groove of 106 therein around the circumference thereof of predetermined dimensions such as $\frac{5}{8}$" wide×1/32" deep located proximate the center of the sixth roller as shown in FIG. 6. The purpose of the second groove is to prevent contact of the sixth roller 102 with the seal strip 12.

Preferably, the first cylindrical roller means 44 comprises a third cylindrical roller 108. The third roller 108 has a first roller portion 110 of predetermined dimensions such as 2.19" in diameter and 1" in height. The third roller 108 has a first coaxial opening 112 at one end 114 thereof predetermined dimensions such as 0.09" deep, 1.06" in diameter. A fourth cylindrical roller 116 has a second roller portion 118 of predetermined dimensions being the same as for the first roller portion 110. The fourth roller having at one end 120 thereof an engagement member section 122 of predetermined dimensions such as 0.130" in height and 1.060" in diameter which is sized to engage the first coaxial opening 112 of the third roller 108 such that a predetermined clearance such as 0.040" remains between the third and fourth rollers defining the first groove 46 of the first cylindrical roller 44.

Preferably, the first and second gear means are two 12-tooth, $\frac{3}{4}$ bore gears such as manufactured by the McMaster-Carr Company Model No. NSS812, for example.

Of course, the foregoing is only put forth as by way of example and is not intended to restrict the scope of the invention, for example, the means for turning the first and second shaft means instead of the handle means as shown may be an electric motor with appropriate gearing.

What I claim is:

1. A seal strip bending device, said seal strip for pressure sealing a stage of a steam turbine, said seal strip consisting of an elongated metallic strip member having a substantially L-shaped cross-section, said L-shaped cross-section including a relatively long central portion and a relatively short lip portion, said device for bending said seal strip along its length to a predetermined diameter, said device comprising:

a. a frame means including a bottom horizontal support member, said bottom support member having affixed thereto at a predetermined distance from one another a pair of substantially parallel vertical wall members, said wall members affixed to said bottom support member at the bottom edges of said wall members, said wall members at the top edges thereof having affixed thereto a top horizontal support member, said top horizontal support member of predetermined dimensions;

b. a first cylindrical roller means, said first roller means supported horizontally by and between said wall members, said first roller means having a first groove therein around the circumference thereof of predetermined dimensions;

c. means for supporting said first cylindrical roller means including a first cylindrical shaft means being supported by said wall members;

d. a second cylindrical roller means supported horizontally by and between said wall members with the axis of said second roller means lying in substantially the same plane as the axis of said first roller means at a predetermined distance beneath said first roller means;

e. means for supporting said second cylindrical roller means including a second cylindrical shaft means being supported by said wall members, said second shaft means in supportive relationship with said second cylindrical roller means;

f. adjustable bending means including a pair of elongated arms of substantially equal length, each of said elongated arms having first aperture means therethrough proximate one end thereof, each of said arms having said first shaft means passing through said first aperture means of said arms in supportive relationship therewith, one of said arms positioned proximate one end of said first cylindrical roller means and the other of said arms positioned proximate the other end of said first cylindrical roller means, each of said arms movable on said first shaft means, a cylindrical bending roller means positioned between and supported by said arms at a predetermined distance from said first cylindrical roller, said bending roller means having second aperture means passing therethrough at predetermined positions, said bending roller means having first threading of predetermined size along the periphery of said second aperture means, adjustment means including screw members passing through said second aperture means engaging said first threading;

g. means for turning said first shaft means and said second shaft means; said first roller means and said second roller means spaced a predetermined clearance from one another, whereby when inserting one end of said seal strip in said first groove of said first roller means such that said lip portion of said L-shaped shaped cross-section of said seal strip is held in said clearance between said first and second roller means, upon the turning of said first and second shaft means, said seal strip is fed to contact said bending roller means, said adjustment means is adjusted to increase or decrease the diameter of the seal strip as desired.

2. The seal strip bending device of claim 1, wherein said means for turning said first shaft means and said second shaft means comprises:

handle means mounted proximate one end of said first shaft means;

first gear means mounted on said first shaft means in predetermined position;

second gear means mounted on said second shaft means in predetermined position in working engagement with said first gear means.

3. The seal strip bending device of claim 1, wherein said first cylindrical roller means comprises a third hollow cylindrical roller, said third roller means having a first roller portion of predetermined dimensions, said third roller means having a first coaxial opening at one end thereof of predetermined dimensions, a fourth cylindrical roller means having a second roller portion of predetermined dimensions, said fourth roller having at one end thereof an engagement member section of predetermined dimensions sized to engage said first coaxial opening of said third roller means such that a predetermined clearance remains between said third and fourth rollers defining said first groove of said first cylindrical roller means.

4. The seal strip bending device of claim 1, wherein the depth of said first groove is a predetermined amount greater than the length of said central portion of said L-shaped cross-section of said seal strip.

5. The seal strip bending device of claim 1, wherein the width of said first groove is a predetermined amount greater than the maximum width of said central portion of said L-shaped cross-section of said seal strip.

6. The seal strip bending device of claim 1, wherein each of said arms of said bending means have third aperture means therethrough positioned a predetermined distance from the center of said first aperture means, each of said arms having fourth aperture means therethrough positioned a predetermined distance from the center of said third aperture means.

7. The seal strip bending device of claim 5, wherein said cylindrical bending roller means includes a fifth bending roller means passing through said third aperture means of said arms proximate the ends thereof, said fifth bending roller means being rotatable within said third aperture means, sixth roller means passing through said fourth aperture means of said arms proximate the ends of said sixth roller means, said sixth roller means being rotatable within said fourth aperture means, said sixth roller means having said second aperture means passing therethrough.

8. The seal strip bending device of claim 6, wherein said sixth roller means has a second groove therein around the circumference thereof of predetermined dimensions.

* * * * *